US006540445B1

(12) United States Patent
Evans, Jr.

(10) Patent No.: US 6,540,445 B1
(45) Date of Patent: Apr. 1, 2003

(54) CONCRETE SILT FENCE

(76) Inventor: Eldon Boyd Evans, Jr., R.R. 3, Box 834, Kempner, TX (US) 76539

( * ) Notice: Subject to any disclaimer, the term of this patent is extended or adjusted under 35 U.S.C. 154(b) by 0 days.

(21) Appl. No.: 09/798,865

(22) Filed: Mar. 1, 2001

(51) Int. Cl.[7] ..... E02D 17/20

(52) U.S. Cl. ..... 405/302.6; 405/258.1; 405/275; 52/741.14; 256/24; 210/170

(58) Field of Search ..... 405/16, 21, 258.1, 405/262, 272, 274, 275, 282, 285–287, 302.6; 52/223.6, 293.1, 741.14, 578, 581; 256/19, 24, 25, 51, 52, 73; 210/170

(56) References Cited

U.S. PATENT DOCUMENTS

| | | | | | |
|---|---|---|---|---|---|
| 792,593 | A | | 6/1905 | Himmelwright | |
| 2,695,159 | A | | 11/1954 | Bridwell | |
| 3,747,287 | A | * | 7/1973 | Finger | 52/293.1 X |
| 3,953,976 | A | * | 5/1976 | Morren et al. | 405/21 |
| 4,145,861 | A | | 3/1979 | Yarnick | |
| 4,290,246 | A | | 9/1981 | Hilsey | |
| 4,325,457 | A | | 4/1982 | Docherty et al. | |
| 4,472,919 | A | * | 9/1984 | Nourse | 52/601 |
| 4,605,090 | A | | 8/1986 | Melfi | |
| 4,643,618 | A | * | 2/1987 | Hilfiker et al. | 405/287 |
| 4,756,511 | A | * | 7/1988 | Wright, III | 256/12.5 |
| 5,078,367 | A | | 1/1992 | Simpson et al. | |
| 5,108,224 | A | * | 4/1992 | Cabaniss et al. | 405/21 X |
| 5,368,416 | A | * | 11/1994 | Cataldo | 405/258.1 X |
| 5,426,267 | A | * | 6/1995 | Underhill et al. | 181/210 |
| 5,468,098 | A | | 11/1995 | Babcock | |
| 5,509,249 | A | * | 4/1996 | House et al. | 256/19 X |
| 5,524,405 | A | * | 6/1996 | Byrd | 52/293.1 X |
| 5,946,881 | A | | 9/1999 | Chatelain | |
| 5,987,827 | A | | 11/1999 | Lord | |
| 6,086,288 | A | * | 7/2000 | Ruel et al. | 405/262 |

FOREIGN PATENT DOCUMENTS

| | | | |
|---|---|---|---|
| DE | 3422865 | * | 1/1985 |
| JP | 07202473 | * | 8/1995 |
| JP | 2000303599 | * | 10/2000 |

* cited by examiner

*Primary Examiner*—Jong-Suk (James) Lee
(74) *Attorney, Agent, or Firm*—Molly D. McKay

(57) ABSTRACT

A concrete silt fence constructed of a plurality of very thin, steel reinforced concrete panels that are aligned side by side and fixed in a trench in the ground to form a fence. Each of the panels is constructed of reinforcing steel bars and concrete. The steel bars are aligned parallel to each other and centered in the neutral axis of the panel. A steel bar is provided adjacent each of the two side walls of the panel to provide shear strength to the side edges of the panel, and one or more steel bars are provided between these two outside steel bars. A thin coating of concrete is poured around the reinforcing steel bars so that each pre-cast panel contains so little concrete that it does not satisfy the American Concrete Institute's standard for minimum concrete cover of reinforcement for pre-cast concrete wall panels that are exposed to earth or weather.

4 Claims, 2 Drawing Sheets

CONCRETE SILT FENCE

BACKGROUND OF THE INVENTION

1. Field of the Invention

The present invention relates to a concrete fence constructed of individual panels of steel reinforced concrete. The panels are made so thin that they do not conform to the American Concrete Institute's standards for concrete thickness for protection for reinforcement. These panels are secured in the ground so that the panels align with each other to form a fence. A fence constructed of these panels will visibly deflect when the design loading is applied to the fence and will resume its original configuration when the loading is removed without damaging either the reinforcing steel or the concrete skin on the reinforcing steel.

2. Description of the Related Art

Concrete panels are used for various purposes, including fencing material. The concrete panels that are currently in use for fencing material are designed so that wind forces impacting the fence will not cause the concrete panels to noticeably deflect. These prior art concrete panels have been constructed so that the panels remain rigid, even under maximum design loading.

One of the standards that specifies the thickness of concrete to be used in steel reinforced concrete panels is the American Concrete Institute (ACI) standard for concrete protection for reinforcement. The ACI standard for concrete cover as protection of reinforcement against earth or weather and other effects is measured from the concrete surface to the outermost surface of the steel to which the cover requirements applies. Currently, under the ACI standard (ACI 318-77), the minimum concrete cover of reinforcement for pre-cast concrete wall panels that are exposed to earth or weather is ¾ inches of concrete surrounding the reinforcement for no. 11 bar and smaller.

The present invention is constructed of steel reinforced concrete panels that are made very thin so that they contain so little concrete that they do not satisfy the ACI standard for minimum concrete cover of reinforcement for pre-cast concrete wall panels that are exposed to earth or weather. These ACI standards are published by the American Concrete Institute and can be obtained from that organization which can be reached at the following address: American Concrete Institute, Box 19150, Redford Station, Detroit, Mich. 48219.

A fence constructed of these very thin panels is lighter in weight than conventional concrete fence panels, making it less expensive to manufacture and easier and less expensive to transport and install.

Current wisdom says that steel reinforced concrete wall panels should be rigid, even under maximum load conditions. The present invention does not remain rigid under maximum load conditions, but instead bends or deflects visibly. The panels of the present invention remain in the elastic range even under maximum load conditions so that the panels return to their original pre-deflection configuration when the load is removed. The unexpected thing about the present invention is that the concrete does not crack as a result of the deflection the panels undergo. Instead, the thin concrete skin flexes with the underlying reinforcing steel bars. The reinforcing steel bars extend longitudinally within each panel and primarily provide the structural strength to the panel, although the thin concrete skin does provide a stiffness contribution.

SUMMARY OF THE INVENTION

The present invention is a concrete silt fence constructed of a plurality of very thin steel reinforced concrete panels that are aligned side by side and secured in the ground to form a fence. The panels may be fixed in a trench in the ground by backfilling and compacting fine granular material against the lower ends and sides of the panels or by placing concrete around the lower ends and sides of the panels to fill the trench. The fence may be used to retain silt or for other purposes, such as for example security fences or privacy fences.

Each of the panels is constructed of reinforcing steel bars and concrete. The steel bars are aligned parallel to each other and parallel with the longitudinal axis of the panel. A steel bar is provided adjacent each of the two side walls of the panel to provide shear strength to the side edges of the panel, and one or more steel bars are provided between these two outside steel bars. A thin coating of concrete is placed around the reinforcing steel bars so that each pre-cast panel contains so little concrete that it does not satisfy the ACI standard for minimum concrete cover of reinforcement for pre-cast concrete wall panels that are exposed to earth or weather, i.e. does not have ¾ inch of concrete covering the reinforcing steel bars for no. 11 bar and smaller.

The present invention does not remain rigid under maximum design load conditions, but instead bends or deflects visibly. The panels of the present invention remain in the elastic range even under maximum design load conditions so that the panels return to their original pre-deflection configuration when the load is removed and the concrete does not crack as a result of the deflection the panels undergo. Instead, the thin concrete skin flexes with the underlying reinforcing steel bars. The reinforcing steel bars extend longitudinally within each panel and generally provide the structural strength to the panel, although the thin concrete skin does provide a stiffness contribution.

DETAILED DESCRIPTION OF THE PREFERRED EMBODIMENT

The Invention

Figure 1:
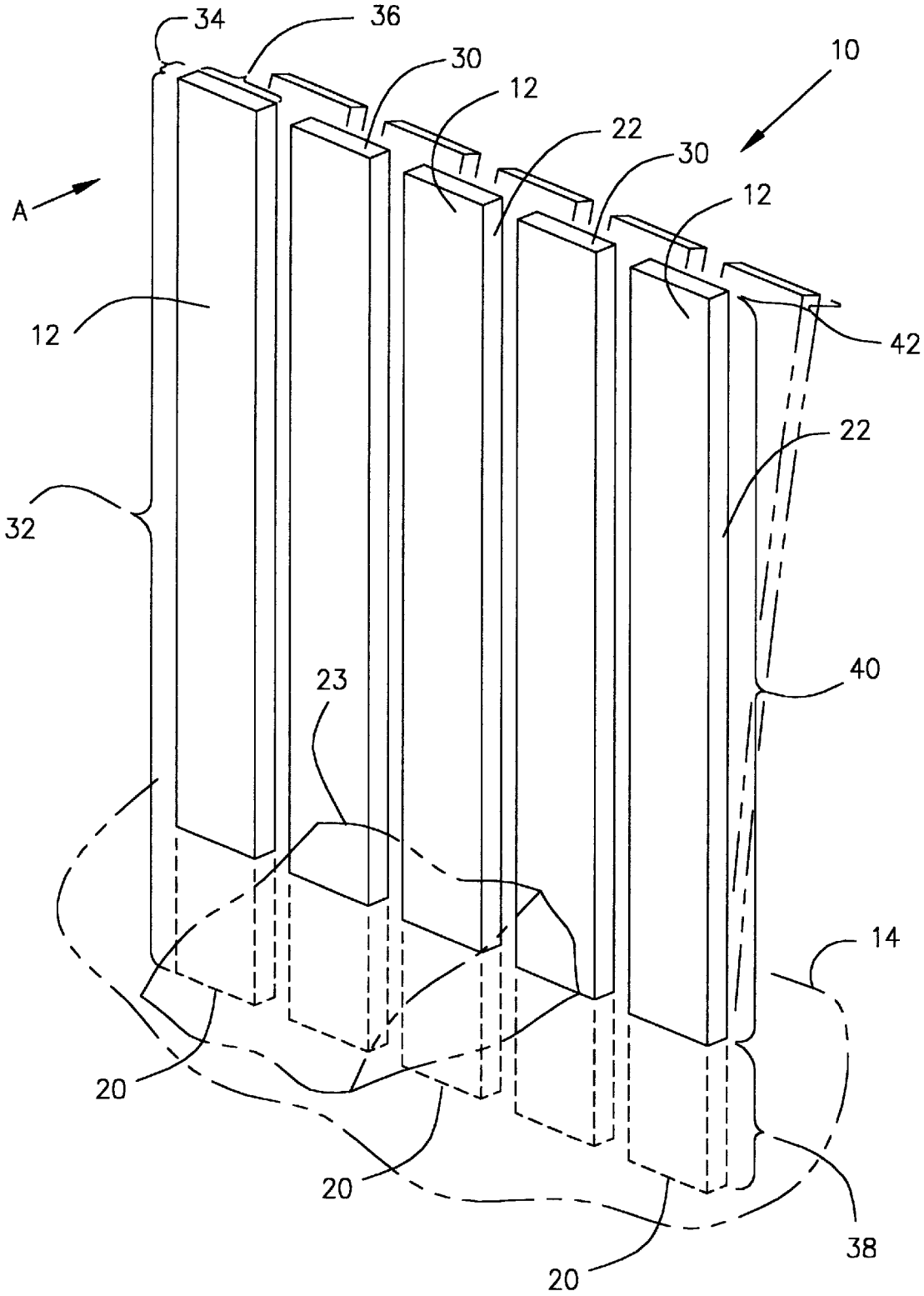
FIG. 1 is a perspective view of a concrete silt fence constructed in accordance with a preferred embodiment of the present invention.
Figure 2:
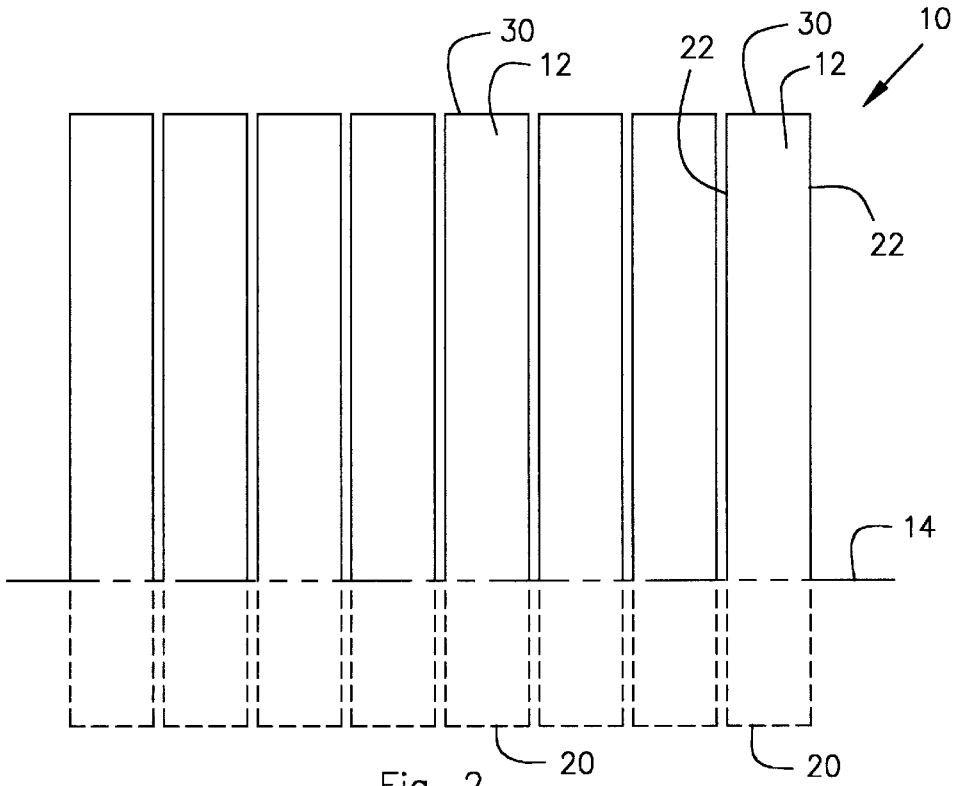
FIG. 2 is a front view of the concrete silt fence of FIG. 1.

Referring now to the drawings and initially to FIGS. 1 and 2, there is illustrated a concrete silt fence 10 constructed of a plurality of very thin steel reinforced concrete panels 12 that are aligned side by side and secured in the ground 14 to form the fence 10. The panels 12 are so thin that they do not meet the minimum American Concrete Institute's standards for concrete thickness for protection for reinforcement.

As illustrated in FIG. 2, the fence 10 is formed by erecting the panels 12 so that the panels 12 are aligned in a row approximately perpendicular to the ground 14, and side walls 22 of adjacent panels 12 are either abutting or slightly spaced apart from each other. If desired, the panels 12 can be attached to each other by means of dowel pins or a tongue and groove arrangement. However, regardless of whether the panels 12 are attached to each other, abut each other or are slightly spaced apart from each other, the fence 10 will function the same way.

Figure 3:
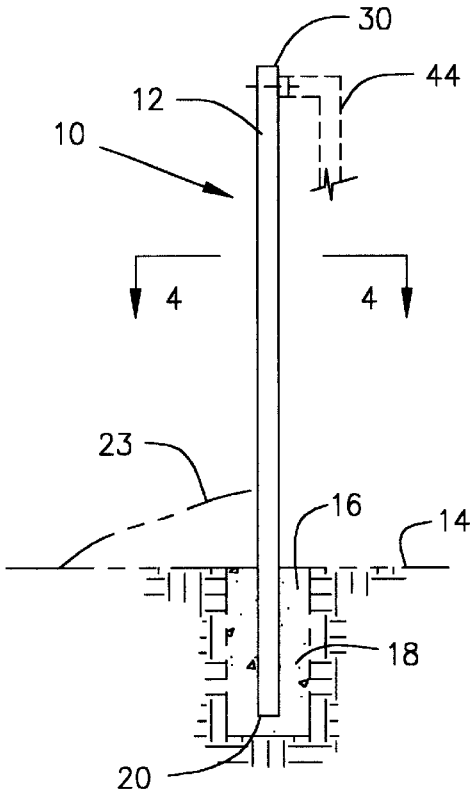
FIG. 3 is side view of the concrete silt fence of FIG. 2, with an optional support member shown in outline.

As illustrated in FIG. 3, to install the fence 10, the aligned panels 12 are placed in a trench 16 created in the ground 14. Backfill material 18 is placed against the lower ends 20 and the sides of the trench 16. The material 18 that is used to backfill may be any suitably material, such as compacted fine granular material or concrete. As illustrated in FIG. 1, the fence 10 may be used to retain silt 23 at construction sites or for other purposes, such as a security fence, a privacy fence, or a snow-retaining fence.

Figure 4:
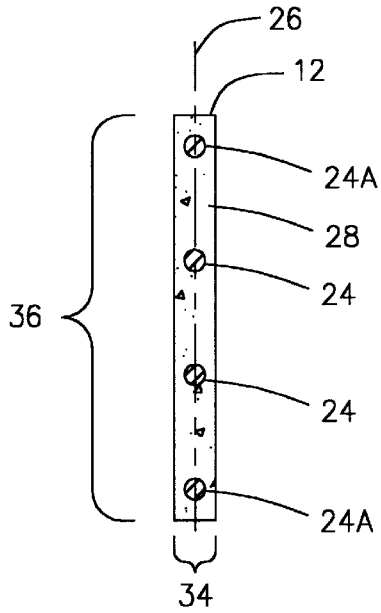
FIG. 4 is a cross sectional view of one panel of the fence taken along line 4—4 of FIG. 3.

As illustrated in FIGS. 3 and 4, each of the panels 12 is constructed of reinforcing steel bars 24 and concrete 28. The steel bars 24 are selected to provide the primary structural strength for the desired panel size for the maximum design loading force, i.e. the maximum wind force that the fence is built to withstand without the fence 10 failing. A fence 10 is considered to fail when the panels 12 have deflected beyond their elastic range and are permanently deformed by the force acting upon them. Each of the steel bars 24 are aligned parallel to each of the other bars 24 and placed in a neutral axis 26 of the panel 12. Each steel bar 24 extends from the lower end 20 of the panel 12 to an opposite upper end 30 of the panel 12. A steel bar 24A is provided adjacent each of the two side walls 22 of the panel 12 to provide shear strength to the side walls 22 of the panel 12, and one or more steel bars 24 are provided between these two outside steel bars 24A. A thin coating of concrete 28 is poured around the reinforcing steel bars 24 and 24A so that when the concrete 28 hardens to form a pre-cast panel 12, each panel 12 contains so little concrete 28 that it does not satisfy the ACI standard for minimum concrete cover of reinforcement for pre-cast concrete that is exposed to earth or weather, i.e. does not have ¾ inch of concrete 28 covering the reinforcing steel bars 24 and 24A for no. 11 bar and smaller.

The panels 12 bend or deflect, as shown in outline in FIG. 1, when the fence 10 is placed under maximum load conditions, as indicated by Arrow A. The distance that the fence 10 is deflected is of a magnitude that an observer can readily see that the upper ends 30 of the panels 12 have moved out of their normal perpendicular orientation. For example as illustrated in FIG. 1, a fence 10 constructed of panels 12 that are eight (8) feet in length 32, one (1) inch in thickness 34 and nine (9) inches in width 36 that have the lower two (2) feet of their length 38 buried in the ground 14 so that the remaining six (6) feet length 40 of the fence 10 extends above the ground 14 will deflect a distance 42 of approximately four (4) inches when placed under a seventy (70) mile per hour wind loading Arrow A.

The panels 12 of the fence 10 remain in the elastic range even under maximum load conditions so that the panels 12 return to their original pre-deflection configuration, i.e. perpendicular orientation relative to the ground 14, when the load is removed. The concrete 28 does not crack as a result of the deflection the panels 12 undergo. Instead, the thin concrete layer or skin 28 flexes with the underlying reinforcing steel bars 24 and 24A.

As illustrated in outline in FIG. 3, for those installations where deflection of the upper ends 30 of the panels 12 is not desired, vertical support members 44 may optionally be provided attaching to the upper ends 30 to hold the panels 12 in a vertical position even when placed under maximum load conditions.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A concrete silt fence consisting of:

a plurality of precast steel reinforced concrete panels, each panel being flexible without cracking to a wind loading side walls of each of said panels aligned with side walls of adjacent panels to form a fence, steel reinforcing bars provided within each of said panels so that the reinforcing bars provide the primary structural strength for the panel, each on said steel reinforcing bar running the length of the panel and lying centered in a neutral axis of the panel, a concrete layer covering the bars, said concrete layer of a thickness less than the diameter of the reinforcing bars.

2. A concrete silt fence according to claim 1 wherein one of said reinforcing bars is provided in the panel adjacent each of said side walls.

3. A concrete silt fence according to claim 1 wherein the concrete layer covering the steel bars is less that ¾ inch in thickness.

4. A concrete silt fence according to claim 1 wherein the thin concrete layer covering the steel bars results in reinforced concrete panels that deflect when subjected to design the wind loading more than maximum design load allowable deflection without damaging to a concrete structure.

* * * * *